US006263656B1

(12) United States Patent
Barauke

(10) Patent No.: US 6,263,656 B1
(45) Date of Patent: Jul. 24, 2001

(54) ARRANGEMENT AND METHOD FOR CONDENSING A DRAFTED FIBER STRAND AND METHOD FOR MAKING YARN THEREFROM

(75) Inventor: Norbert Barauke, Donzdorf (DE)

(73) Assignee: Spindelfabrik Suessen, Schurr, Stahlecker & Grill GmbH, Suessen (DE)

( * ) Notice: Subject to any disclaimer, the term of this patent is extended or adjusted under 35 U.S.C. 154(b) by 0 days.

(21) Appl. No.: 09/597,614

(22) Filed: Jun. 20, 2000

Related U.S. Application Data

(62) Division of application No. 09/266,898, filed on Mar. 12, 1999, now Pat. No. 6,108,873.

(30) Foreign Application Priority Data

Mar. 31, 1998 (DE) ..... 198 14 204
Oct. 8, 1998 (DE) ..... 198 46 268

(51) Int. Cl.[7] ..... D01H 5/28

(52) U.S. Cl. ..... 57/315; 19/150; 19/244; 19/246; 19/288

(58) Field of Search ..... 19/150, 236–250, 19/252, 263, 286, 287, 288, 304–308; 57/304, 315; 198/689.1, 819; 428/234

(56) References Cited

U.S. PATENT DOCUMENTS 2,659,936 11/1953 Sandelin .
2,774,995 12/1956 Sandelin .

(List continued on next page.)

FOREIGN PATENT DOCUMENTS 361 814 4/1981 (AT) .
857 168 11/1952 (DE) .
882 066 7/1953 (DE) .
900 182 12/1953 (DE) .
1 035 024 7/1958 (DE) .
1 039 422 3/1959 (DE) .
1 178 749 9/1964 (DE) .
43 23 472 1/1995 (DE) .
296 00 417 U 4/1996 (DE) .
197 41 441 9/1997 (DE) .
198 15 054 4/1998 (DE) .
0085017 8/1983 (EP) .
0 635 590 1/1995 (EP) .
1 044 932 6/1953 (FR) .
1 117 278 5/1956 (FR) .
1 490 473 6/1967 (FR) .
1 503 693 10/1967 (FR) .
827787 6/1957 (GB) .
WO 98/39505 9/1998 (WO) .

*Primary Examiner*—John J. Calvert
*Assistant Examiner*—Gary L. Welch
(74) *Attorney, Agent, or Firm*—Crowell & Moring, L.L.P.

(57) ABSTRACT

A condensing zone is arranged downstream of the front roller pair of a drafting arrangement of a spinning machine, in which condensing zone a drafted roving or a sliver is condensed. The condensing zone has a suction device which has a closed hollow profile and which serves as a sliding surface for a circulating sieve belt. The sieve belt transports the drafted fiber strand to a nipping roller, which presses the fiber strand and the sieve belt against the sliding surface at a nipping point. The fiber strand travels over an essentially in transport direction extending suction slit located in the condensing zone, which suction slit extends to the nipping point.

6 Claims, 6 Drawing Sheets

U.S. PATENT DOCUMENTS

| | | | | |
|---|---|---|---|---|
| 3,090,081 | * | 5/1963 | Klein | 19/288 |
| 3,122,794 | * | 3/1964 | Klein | 19/288 |
| 3,438,094 | * | 4/1969 | Field, Jr. | 19/288 |
| 3,728,066 | * | 4/1973 | Stadler et al. | 425/471 |
| 3,851,681 | * | 12/1974 | Egan | 139/420 R |
| 3,889,801 | * | 6/1975 | Boyer | 198/184 |
| 3,915,202 | * | 10/1975 | Curtis et al. | 139/425 A |
| 4,485,528 | * | 12/1984 | Anahara et al. | 19/258 |
| 4,488,397 | | 12/1984 | Venot . | |
| 4,497,089 | * | 2/1985 | Anahara et al. | 19/246 |
| 4,953,349 | | 9/1990 | Feher | 57/315 |
| 5,062,220 | * | 11/1991 | Keilhack | 34/155 |
| 5,600,872 | | 2/1997 | Artzt et al. . | |
| 5,699,707 | * | 12/1997 | Campbell, Jr. | 198/811 |
| 6,032,789 | * | 3/2000 | Mayer et al. | 198/819 |

* cited by examiner 9
5
2
A
1
6
3
13
12
14
7
4
8
28
24
10
20
23
15
21
16
II
17
26
11
25
B 9
5A
2A
A
1A
6A
3A
13A
12A
14A
7A
4A
8A
30A
15A
10
20A
23A
IV
21A
16A
17A
25A
26A
11A
B

ARRANGEMENT AND METHOD FOR CONDENSING A DRAFTED FIBER STRAND AND METHOD FOR MAKING YARN THEREFROM

This application is a divisional of Ser. No. 09/266,898 filed Mar. 12, 1999 U.S. Pat. No. 6,108,873.

BACKGROUND AND SUMMARY OF THE INVENTION

This application claims the priority of German applications 198 14 204.8 filed Mar. 31, 1998 in Germany, and 198 46 268.9 filed Oct. 8, 1998 in Germany, the disclosures of which are expressly incorporated by reference herein.

The present invention relates to an arrangement for condensing a drafted fiber strand in a condensing zone arranged downstream of a front roller pair of a drafting arrangement, which condensing zone comprises a stationary sliding surface having at least one suction slit extending essentially in a fiber transport direction and a perforated transport belt which transports the fiber strand over the sliding surface, to which transport belt a nipping roller, defining the delivery side of the condensing zone, is arranged.

An arrangement of this general type is described in U.S. Pat. No. 5,600,872. The drafting of the sliver or the roving ends at the front roller pair. A condensing zone is located between the front roller pair and a delivery roller pair arranged downstream thereof, in which condensing zone the drafted fiber strand is condensed transversely to the transport direction, so that when exiting the delivery roller pair, a spinning triangle does not arise when the fiber strand is subsequently twisted to a yarn. The perforation corresponds to the width to which the fiber strand is to be condensed. A belt cradle effects the guidance of the belt, which cradle takes the form of a suction device and comprises a sliding surface.

As a result of a delivery roller pair being arranged downstream of the suction device, the suction of the fiber strand ends at a clear distance from the nipping point of the delivery roller pair. The condensed fiber strand can, disadvantageously, spread out again before it reaches the nipping point. Thus the actual aim of the condensing zone is only partly achieved.

It is an object of the present invention to arrange the condensing zone downstream of the front roller pair of the drafting arrangement in such a way that the condensed fiber strand retains its condensed state until it reaches the nipping point.

This object has been achieved in accordance with the present invention in that the nipping roller presses the transport belt to a nipping point on the sliding surface and that the suction slit extends to the nipping point.

As the nipping roller does not operate in conjunction with another delivery roller, but rather with a stationary sliding surface, the suction can be applied up to the nipping point. The width of the condensing effect is not determined by the perforation of the transport belt, but rather by the width of the suction slit applied in the sliding surface, which suction slit extends up to the nipping point defined by the nipping roller. An advantage is attained in that the pneumatically generated condensing of the fiber strand is maintained also at the nipping point, so that subsequently a fiber strand, still in a condensed state, can be twisted into a yarn. The result is a yarn with a good material utilization and high tensile strength which is less hairy.

The condensing effect can be increased when the suction slit is designed tapering in transport direction of the fiber strand and/or when the suction slit extends diagonally to the direction of motion of the transport belt. In the latter case, the fiber strand obtains a slight false twist, by means of which, together with the friction effect of the transport belt, the outer fibers can be better wrapped around the fiber strand.

A similar effect can be achieved when the transport belt traverses transversely to its direction of motion.

The transport belt can have various designs. According to especially preferred advantageous embodiments, the transport belt is constituted as a narrow-mesh woven band, which surrounds a sliding surface in the form of a hollow profile. It is hereby favorable when the hollow profile, serving as a sliding surface for the transport belt, is curved in the fiber strand transport direction. In addition to the suction by the suction slit, this results in the fiber strand finding good support on the sliding surface.

In certain preferred embodiments, the hollow profile, in the form of a suction device, extends over a plurality of adjacent spinning stations, whereby as a result one suction device comprises a plurality of suction slits.

The speeds of the nipping roller and the transport belt should be only slightly higher than the speed of the front roller pair, namely by such an amount that a certain necessary tension is effected on the fiber strand. Further drafting is not necessary. In order to achieve this, the nipping roller is driven by a roller of the front roller pair of the drafting arrangement and drives for its part the transport belt. The nipping roller can be arranged together with the top roller of the front roller pair at a joint rocker, which is in turn arranged at the top weighting arm of the drafting arrangement.

The suction slit should be wider than the completed condensed fiber strand, for example 1.5 mm. The perforated area of the transport belt, in contrast, is significantly wider than the suction slit.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
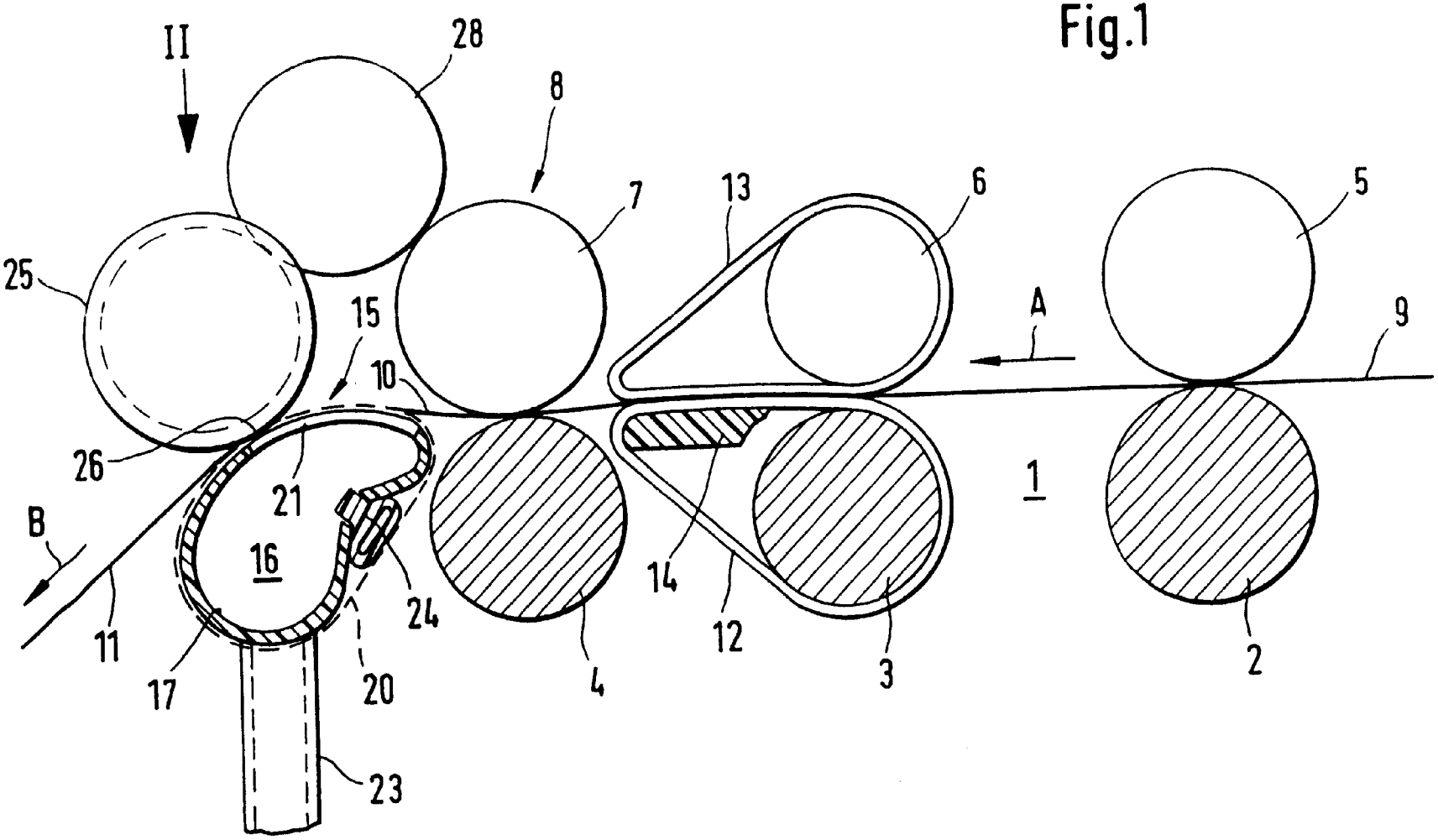
FIG. 1 is a part sectional side schematic view of a drafting arrangement comprising a condensing zone according to the present invention.
Figure 2:
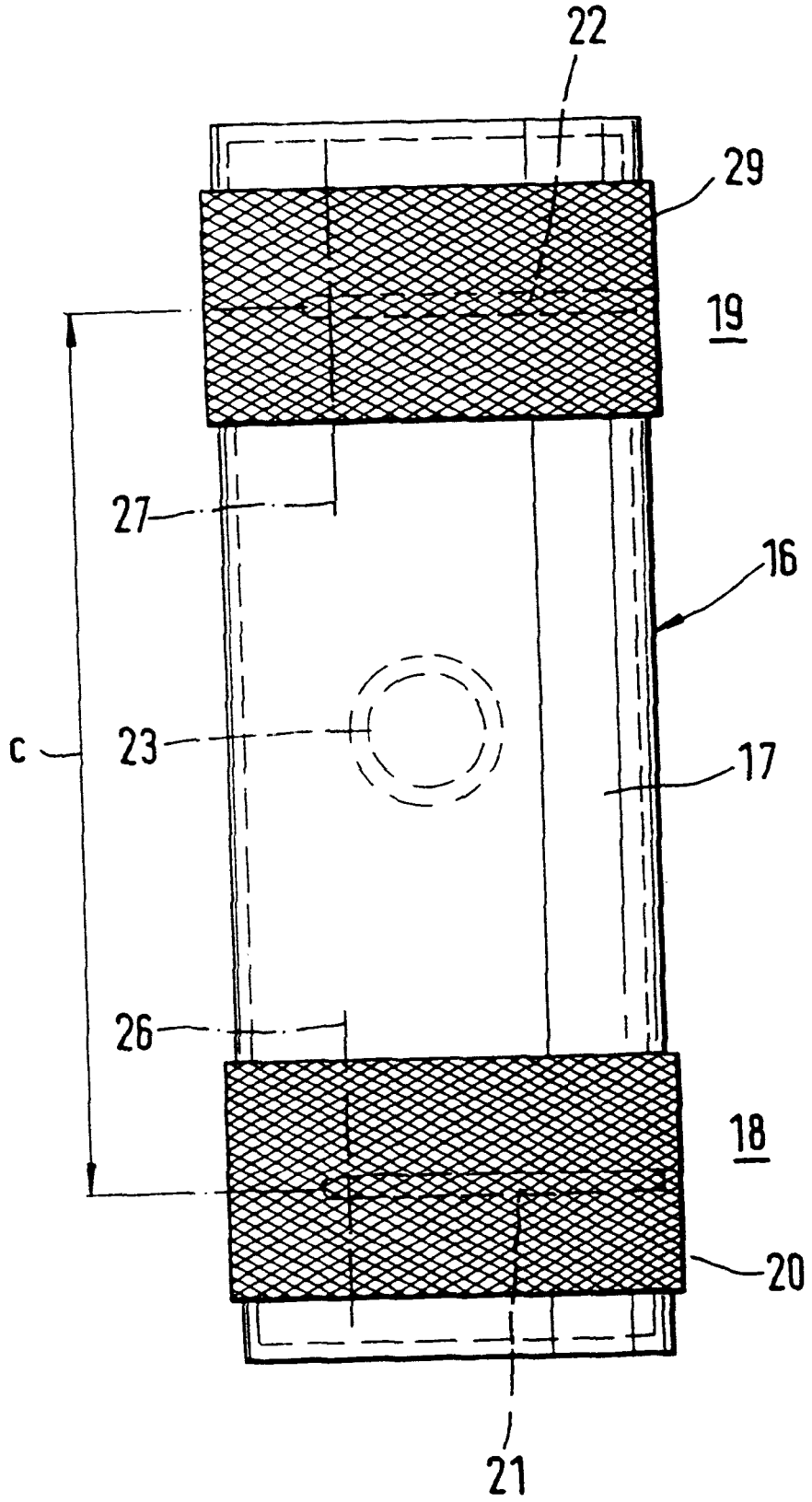
FIG. 2 is a view in the direction of the arrow II of FIG. 1, showing the sliding surface and two transport belts.

The arrangement according to FIGS. 1 and 2 shows a drafting arrangement 1, which comprises three driven bottom rollers 2, 3 and 4, which are arranged in a known way on continuous drive shafts arranged in the machine longitudinal direction. Upper rollers 5, 6 and 7, in the form of pressure rollers, are arranged at the bottom rollers 2,3 and 4. The bottom roller 4 and the top roller 7 form together the front roller pair 8 of the drafting arrangement 1, on which the roving or sliver 9 delivered in direction A undergoes a complete drafting process.

Downstream of the front roller pair 8 therefore, a drafted fiber strand is present, which undergoes a subsequent treatment downstream of the drafting arrangement 1, before it is delivered in delivery direction B to a twisting device, for example a ring spindle, and twisted to a yarn 11.

The middle bottom roller 3, as well as the middle top roller 6 are provided with a lower belt 12 or an upper belt 13. In addition reference is made to a guiding table 14 for the lower belt 12 or an upper belt 13. In addition, reference is made to a guiding table 14 for the lower belt 12.

A condensing zone 15 is arranged downstream of the drafting arrangement 1, which serves the purpose of condensing the drafted fiber strand 10 in such a way that remaining outer fibers still extending out from the fiber strand 10 are disposed on the core of the fiber strand 10. This increases the material utilization and the tensile strength of the yarn 11 to be spun, while reducing hairiness.

A suction device 16 is arranged at the condensing zone 15, which suction device 16 comprises a closed hollow profile 17. The hollow profile 17 extends, as can be seen in particular in FIG. 2, advantageously over two adjacent spinning stations 18 and 19, whose gauge distance to one another is denoted by c.

The hollow profile 17 is comprised of plastic or stainless steel or of any other low-friction coated material. It serves as a sliding surface for two transport belts 20 and 29, which slide thereon, of which each is respectively arranged at a spinning station 18,19.

The transport belts 20,29 are endless and perforated and can take the form of a latticed belt or sieve foil or advantageously as a narrow-meshed woven band. They surround the hollow profile 17 and cover the suction slits 21,22, which are arranged at a gauge distance c from one another. The transport belts 20 and 29 transport the drafted fiber strand 10 to a nipping point 26 or 27, which is formed in that a nipping roller 25 presses the respective transport belt 20 or 29 against the hollow profile 17.

The suction slits 21 and 22 extend in transport direction A and are arranged on the side of the relevant transport belt 20,29 which faces away from the fiber strand 10. The suction slits 21 and 22 are sufficiently long to reach the nipping point 26 or 27.

The suction device 16 is provided with a suction air connection 23, which is located approximately in the center between the two spinning stations 18 and 19. The hollow profile 17 can, as shown in FIG. 1, be additionally provided with a tension element 24 made of plastic, the purpose of which is the tension and guiding of the transport belt 20,29.

The nipping roller 25 drives the respective transport belt 20 or 29 and presses it against the hollow profile 17 of the suction device 16. The nipping roller 25 is driven by the top roller 7 of the front roller pair 8 by a transfer roller 28, namely at a circumferential speed which only slightly exceeds the circumferential speed of the front roller pair 8.

Figure 3:
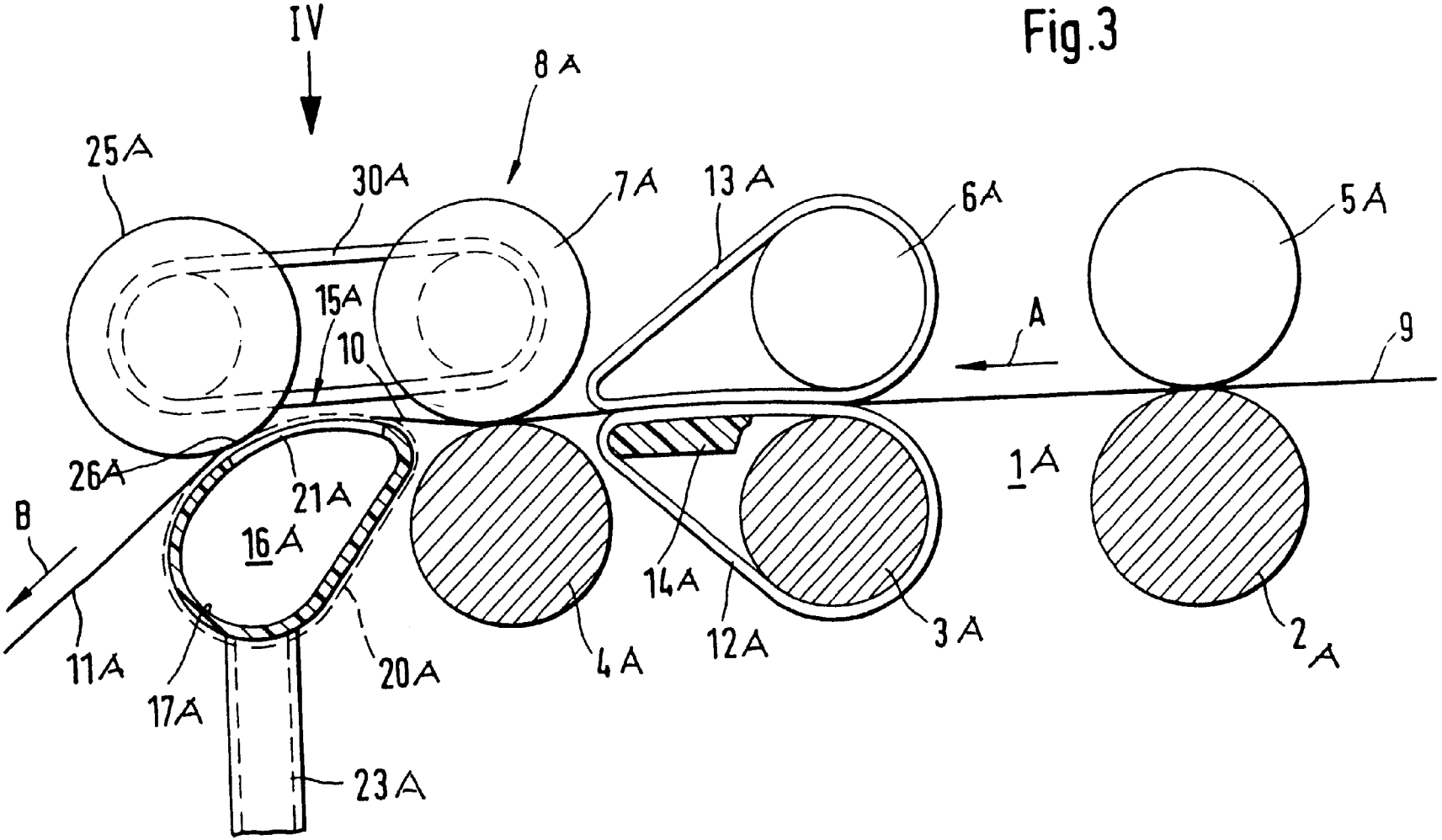
FIG. 3 is a view similar to FIG. 1, showing another embodiment of the invention with a belt drive for the nipping roller.
Figure 4:
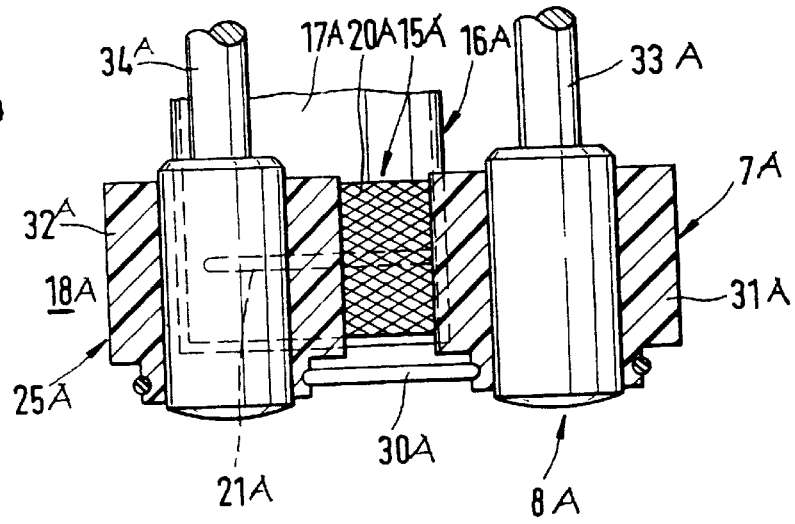
FIG. 4 is a view from above in the direction of the arrow IV of FIG. 3 onto the condensing zone.

In FIGS. 3 and 4, similar reference numbers, with a suffix "A" are used to depict corresponding structures with similar reference numbers as used in FIGS. 1 and 2. Unless indicated otherwise, the description of these structures for FIGS. 1 and 2 also apply.

The embodiment according to FIGS. 3 and 4 differs essentially from the embodiment described above only in that the nipping roller 25A is now driven by means of a transfer belt 30A by the top roller 7A of the front roller pair 8A. It is superfluous to describe the above mentioned components again.

As can be seen from FIG. 4, the top roller 7A, as well as the other top rollers 5A and 6A, and the nipping roller 25A are each provided with a flexible covering 31A or 32A, so that the respective drives can be transferred by means of friction and thus that a flexible pressing is achieved. The axles 33A and 34A of the top roller 7A and the nipping roller 25A can be seen in FIG. 4, which axles are both joined together with the top roller and the nipping roller of the adjacent spinning station to form a twin top roller.

During transport of the drafted fiber strand 10 by means of the very thin woven-like transport belt 20A or 29A, the suction slits 21A and 22A suck the fiber strand 10 and guide the outer fibers together, whereby the fiber strand 10 is condensed. As the suction slits 21A and 22A reach to the nipping point 26A or 27A, the condensed state of the fiber strand 10, in contrast to the prior art described above, remains constant up until the twist is applied.

In the following described embodiments, components which are described above are not repeated here.

Figure 5:
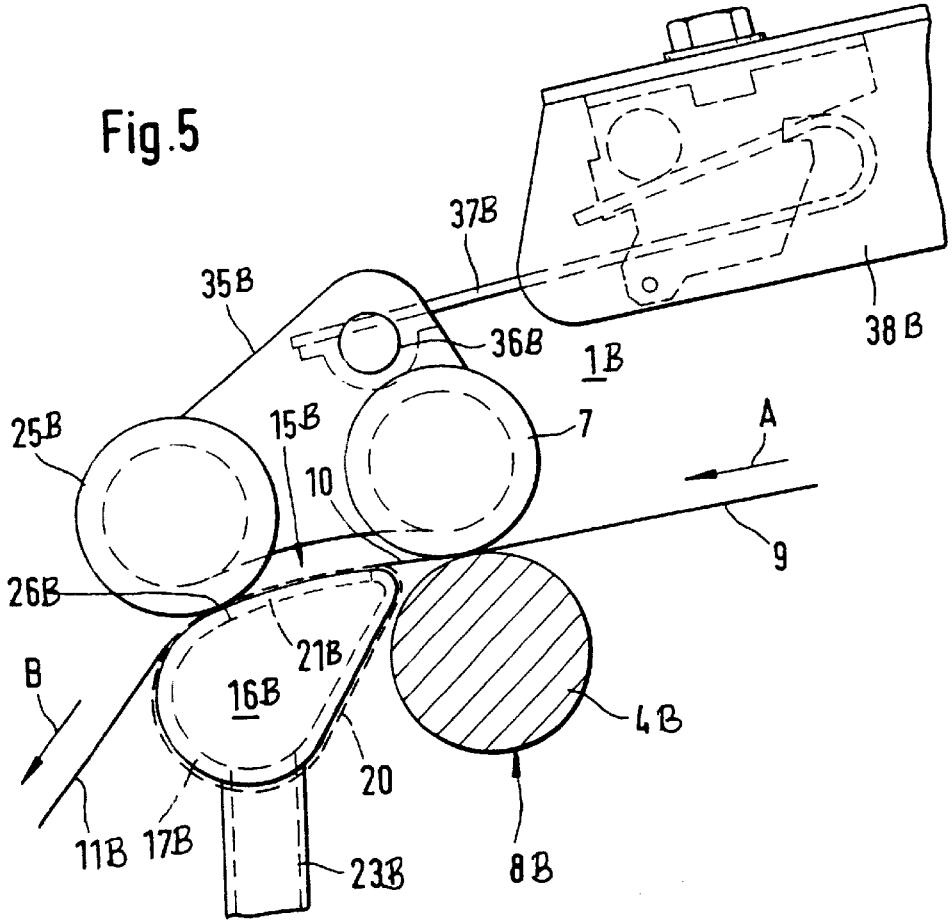
FIG. 5 is a part view similar to FIG. 1, whereby the top roller of the front roller pair and the nipping roller are arranged at a rocker.

In FIG. 5, similar reference numbers, with a suffix "B" are used to depict corresponding structures with similar reference numbers as used in FIGS. 1 and 2. Unless indicated otherwise, the description of these structures for FIGS. 1 and 2 also apply.

According to FIG. 5, the top roller 7B of the front roller pair 8B and the nipping roller 25B of all embodiments can be arranged to a joint rocker 35B. This can be swivelled around a swivel axle 36B, by means of whose position the pressure load of the top roller 7B and the nipping roller 25B can be determined. The rocker 35B is supported by means of a load spring 37B, which is in turn arranged to the top weighting arm 38B of the drafting arrangement 1B.

Figure 6:
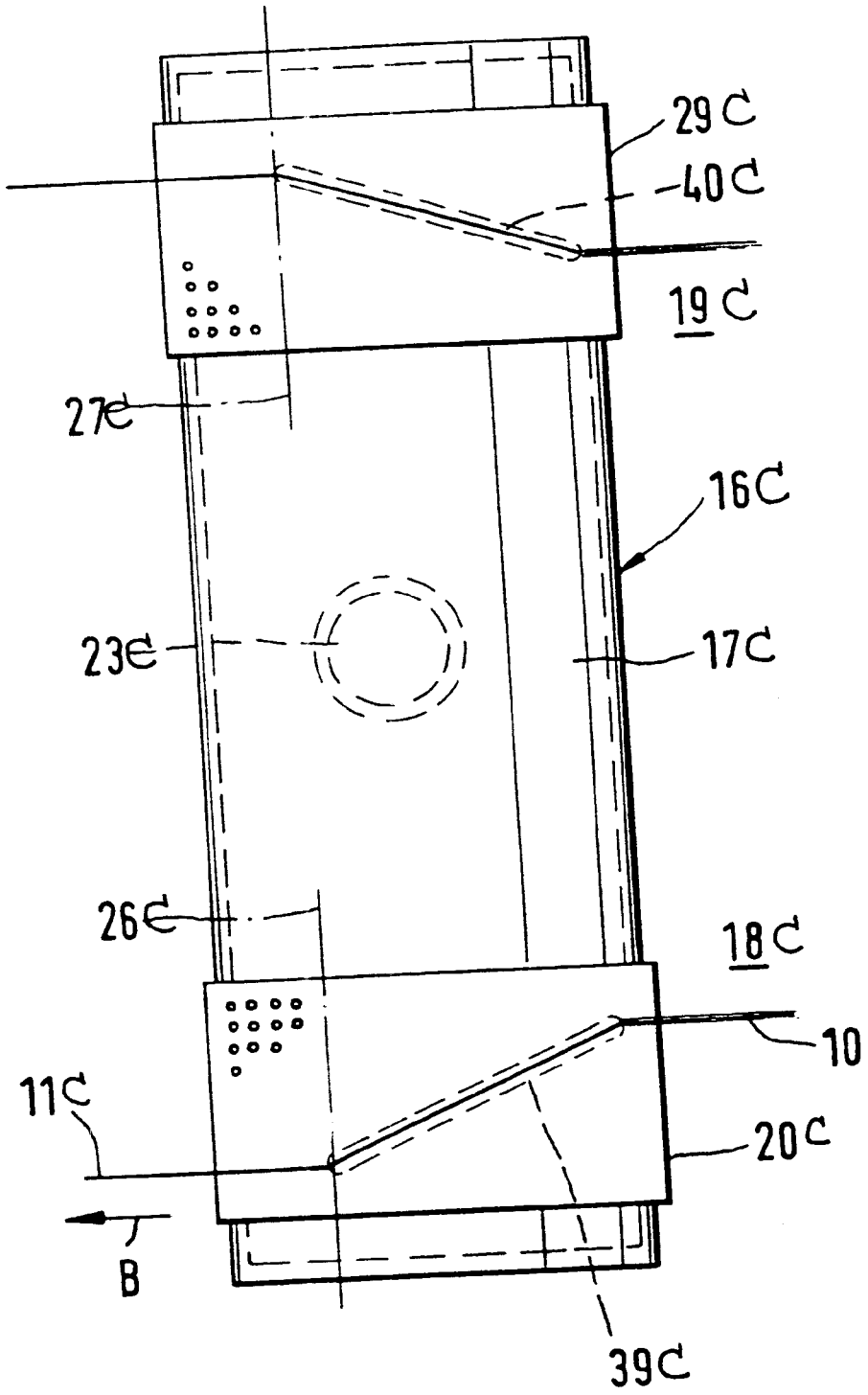
FIG. 6 is a view similar to FIG. 2, whereby the suction slits extend diagonally to the direction of motion of the transport belts.

In FIG. 6, similar reference numbers, with a suffix "C" are used to depict corresponding structures with similar reference numbers as used in FIGS. 1 and 2. Unless indicated otherwise, the description of these structures for FIGS. 1 and 2 also apply.

According to FIG. 6, the suction slits 21 and 22 can be replaced by suction slits 39C and 40C in all embodiments, which suctions slits 39C and 40C extend inclined to the direction of motion of the transport belts 20C and 29C. The respective fiber strand 10 thus receives a slight false twist in addition to its transport direction, as the fiber strand 10 follows the change in direction of the suction slits 39C,40C and thereby rolls on the surface of the respective transport belt 20C,29C. This supports the winding of the outer fibers around the core of the fiber strand 10. Differing from FIG. 6, the diagonal of the suction slits can also be identically aligned, or replaced by a lateral staggering of a plurality of suction slits extending in transport direction.

Figure 7:
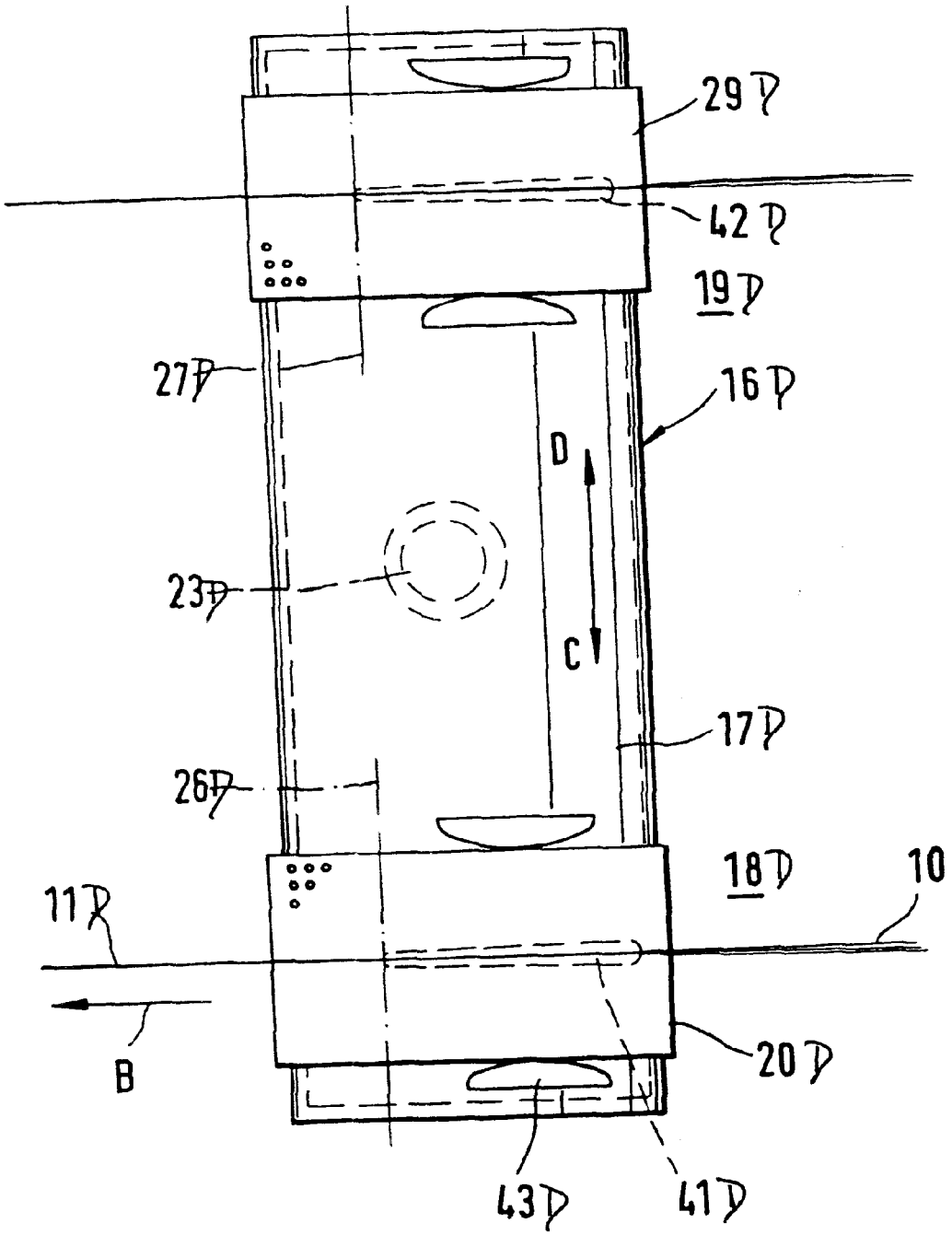
FIG. 7 is a view similar to FIG. 2, whereby the transport belts traverse transversely to their direction of motion.

In FIG. 7, similar reference numbers, with a suffix "D" are used to depict corresponding structures with similar reference numbers as used in FIGS. 1 and 2. Unless indicated otherwise, the description of these structures for FIGS. 1 and 2 also apply.

The suction slits 41D and 42D shown in FIG. 7 taper in transport direction of the fiber strand 10, a measure which can also be provided in the case of the suction slits 21,22, 39C and 40C described above. Furthermore, the hollow profile 17D can be designed traversing according to the traverse directions C and D (in a way not shown here). Corresponding lateral guides 43D ensure that the transport belts 20D and 29D also make this lateral traversing motion. This measure, which can be applied to the embodiments described above, as a single measure or an additional one, ensures an additional rolling of the fiber strand 10, which thus results in an increased condensing.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fiber strand transport belt configured for transporting a fiber strand over a suction slit of a hollow member while the fiber strand is condensed utilizing suction air applied at the suction slit, wherein the transport belt has plural openings disposed laterally adjacent one another which in use open to the suction slit to permit flow of suction air therethrough to facilitate condensing of a fiber strand transported thereby.

2. A fiber strand transport belt according to claim 1, wherein the plural openings extend laterally over an area significantly wider than the suction slit when in an in use position.

3. A fiber strand transport belt according to claim 1, wherein the transport belt is an endless belt.

4. A fiber strand transport belt according to claim 3, wherein the transport belt is a latticed belt.

5. A fiber strand transport belt according to claim 3, wherein the transport belt is a sieve foil belt.

6. A fiber strand transport belt according to claim 3, wherein the transport belt is a narrow-meshed woven band.

* * * * *